US006003269A

United States Patent [19]

McRee

[11] Patent Number: 6,003,269

[45] Date of Patent: Dec. 21, 1999

[54] RETRACTABLE COVERING FOR SPACES

[76] Inventor: Richard T. McRee, 4417 18th St., San Francisco, Calif. 94114

[21] Appl. No.: 08/838,451

[22] Filed: Apr. 7, 1997

[51] Int. Cl.[6] ..... E04B 7/14; E04B 7/16; E04B 1/342; E04C 3/14

[52] U.S. Cl. ..... 52/6; 52/63; 52/66; 52/82; 52/83

[58] Field of Search ..... 52/5, 6, 22, 23, 52/63, 66, 82, 83, 222

[56] References Cited

U.S. PATENT DOCUMENTS

| | | | |
|---|---|---|---|
| 1,286,895 | 12/1918 | Arrel . | |
| 1,711,994 | 5/1929 | Erickson . | |
| 1,800,984 | 4/1931 | Erickson . | |
| 2,140,220 | 12/1938 | Colvin . | |
| 2,692,566 | 10/1954 | Mitchell . | |
| 2,848,756 | 8/1958 | McCann . | |
| 3,510,996 | 5/1970 | Popil . | |
| 4,259,819 | 4/1981 | Wemyss | 52/222 |
| 4,727,688 | 3/1988 | Kida et al. | 52/6 |
| 4,751,800 | 6/1988 | Kida . | |
| 4,942,895 | 7/1990 | Lynch | 135/99 |
| 5,062,243 | 11/1991 | Kumagai | 52/66 |
| 5,167,097 | 12/1992 | Robbie . | |
| 5,203,125 | 4/1993 | Sugizaki . | |
| 5,295,501 | 3/1994 | Vigne | 135/99 |
| 5,311,699 | 5/1994 | Huffman | 47/26 |
| 5,355,641 | 10/1994 | Levy | 52/66 |
| 5,555,681 | 9/1996 | Cawthon | 52/63 |

FOREIGN PATENT DOCUMENTS

| | | | |
|---|---|---|---|
| 219522 | 3/1985 | Germany | 52/66 |
| 86/04371 | 7/1986 | WIPO | 52/66 |

OTHER PUBLICATIONS

Progressive Architecture Fuller p. 1±–137 Jun. 1967 "Bucky's Biggest Bubble".

Architectural Forum Becket p. 9 Sep. 1963 Survey of Stadiums.

Architectural Forum Otto p. 6 Oct. 1966.

*Primary Examiner*—Robert Canfield

[57] ABSTRACT

A retractable covering for buildings (20) or spaces (22) comprising a plurality of flexible retractable panels (32) and attached retractable cables (36) stored at the perimeter of the space and capable of being deployed in a helical pattern converging near a predetermined point above the space.

20 Claims, 9 Drawing Sheets

Figure 3:
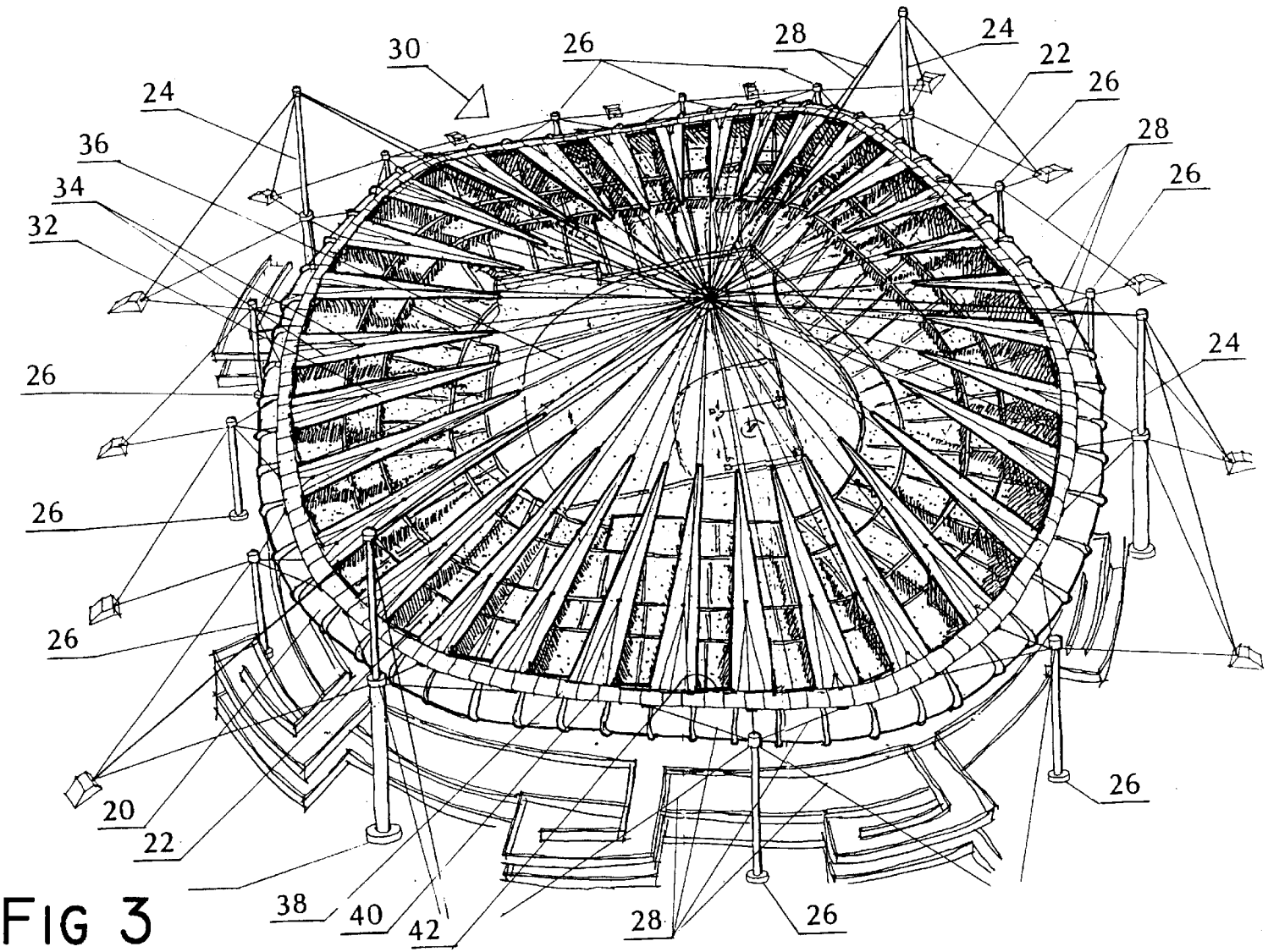

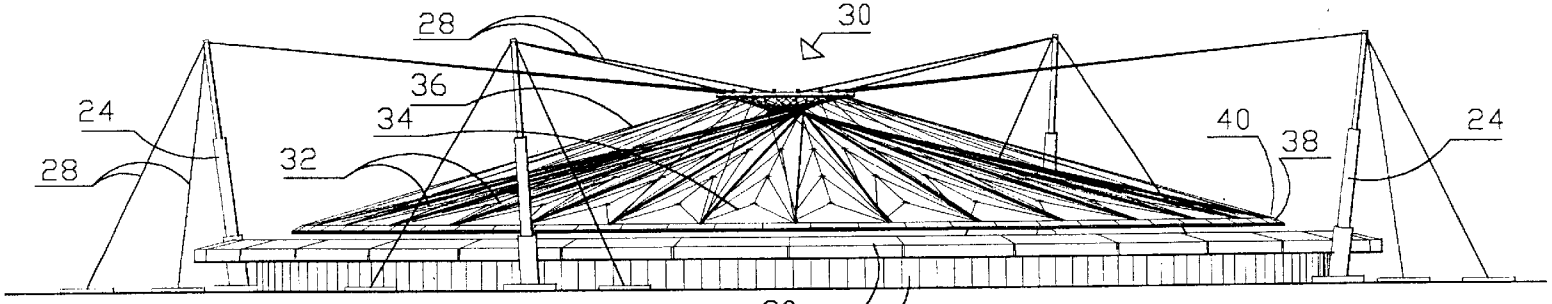
FIG 1-B
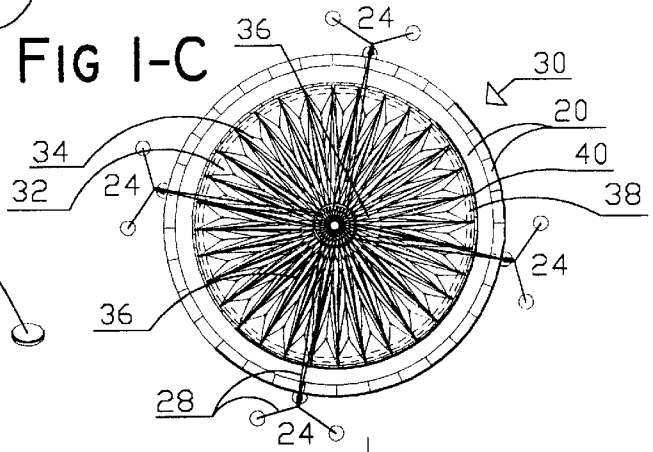
FIG 1-C
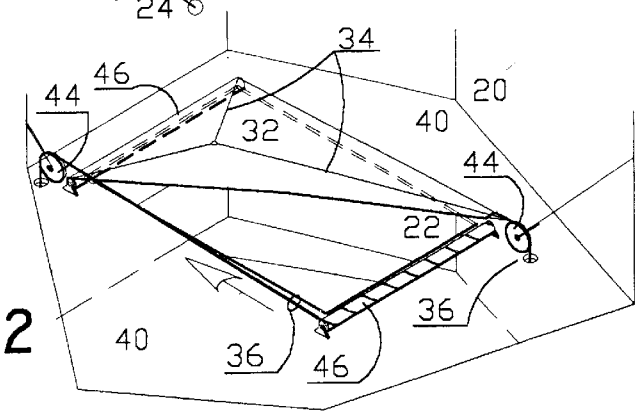
FIG 2
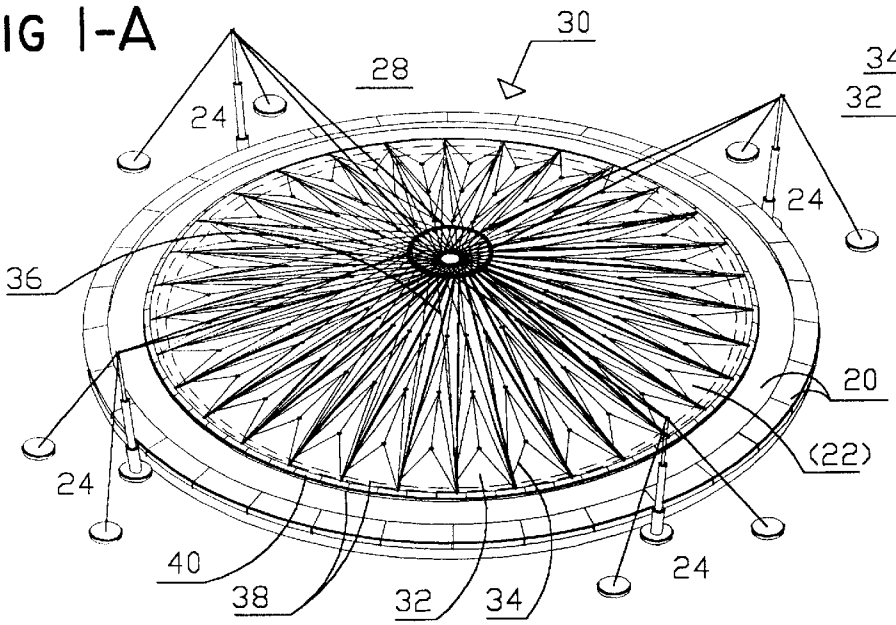
FIG 1-A

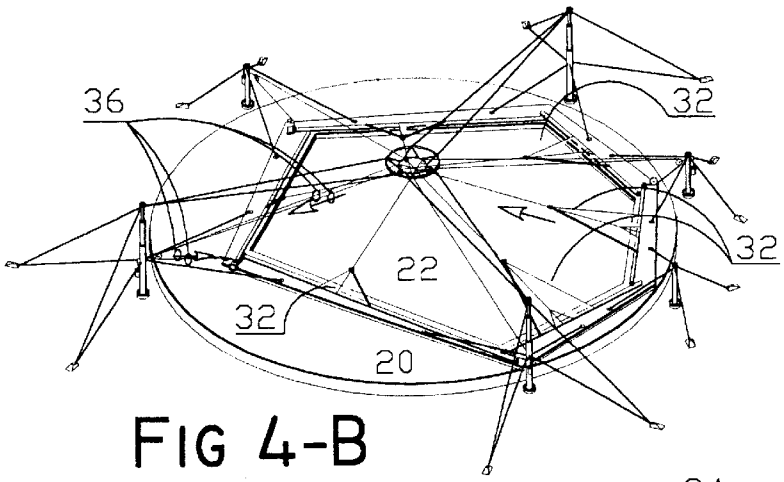
FIG 4-B
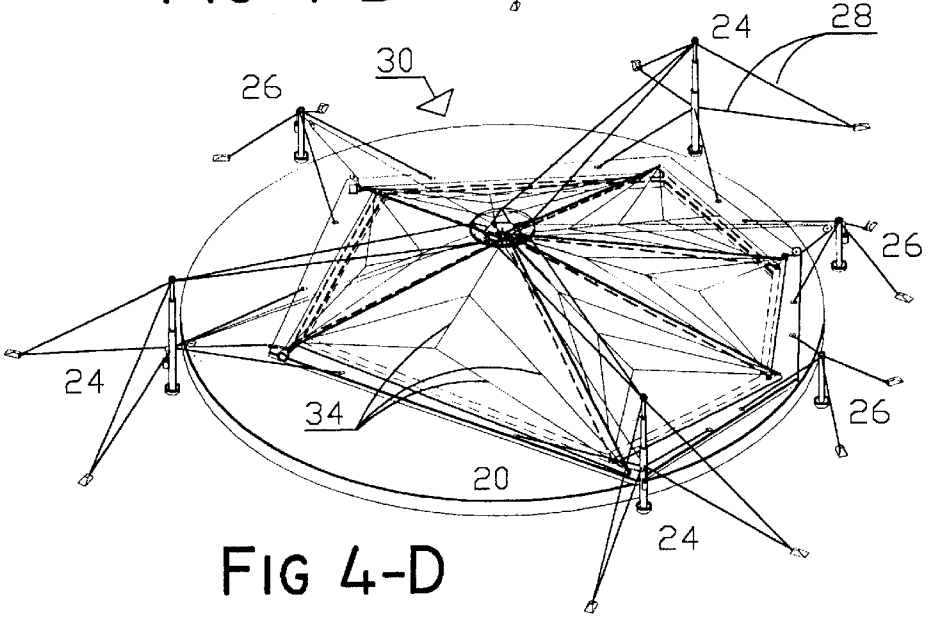
FIG 4-D
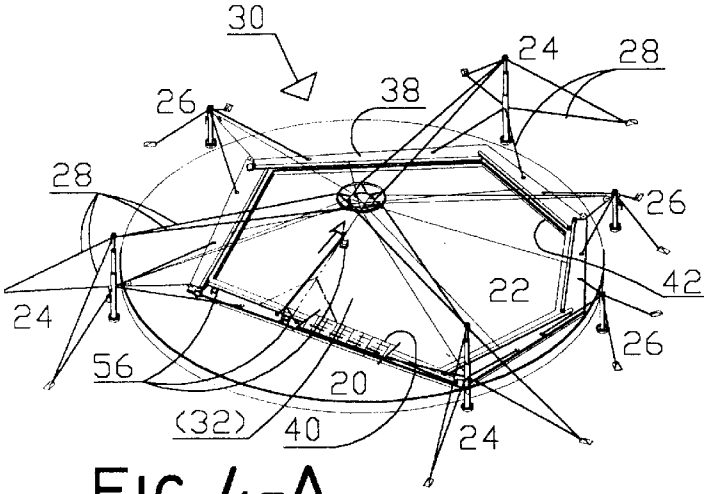
FIG 4-A
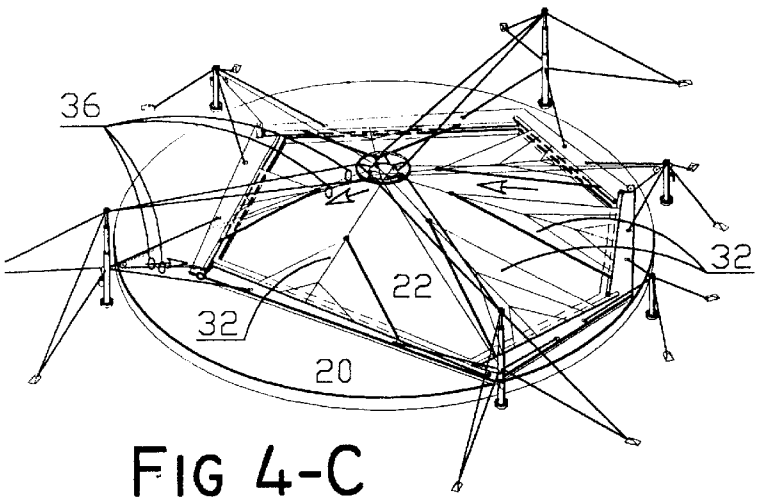
FIG 4-C

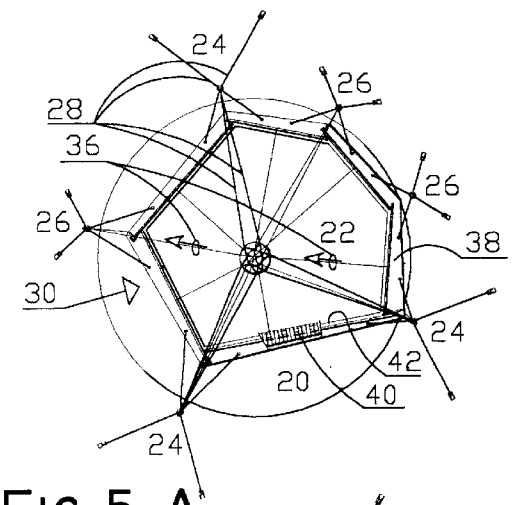
FIG 5-A
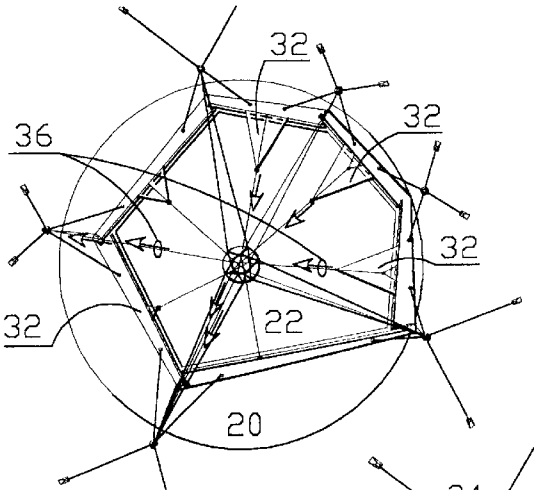
FIG 5-B
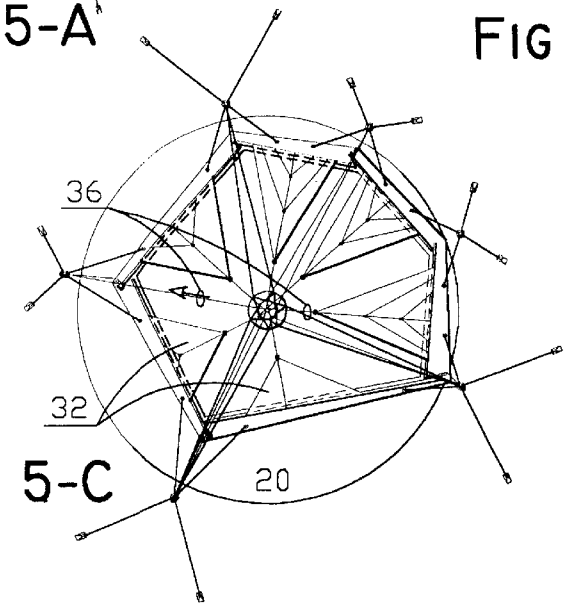
FIG 5-C
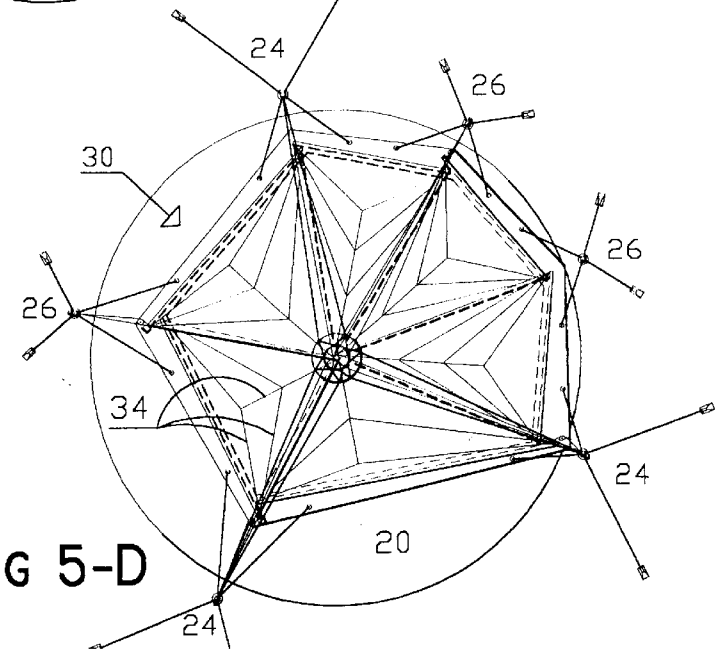
FIG 5-D

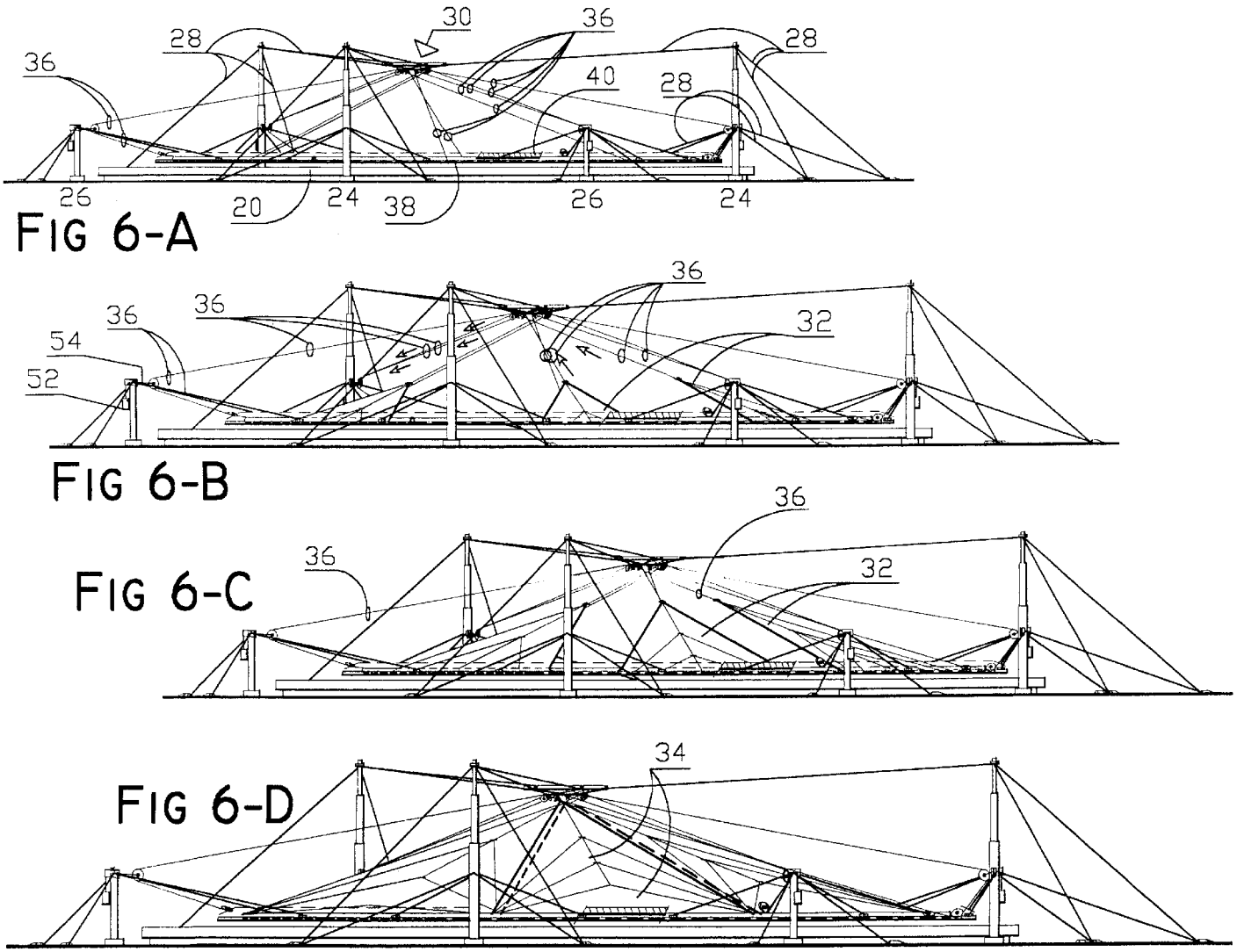
FIG 6-A
FIG 6-B
FIG 6-C
FIG 6-D

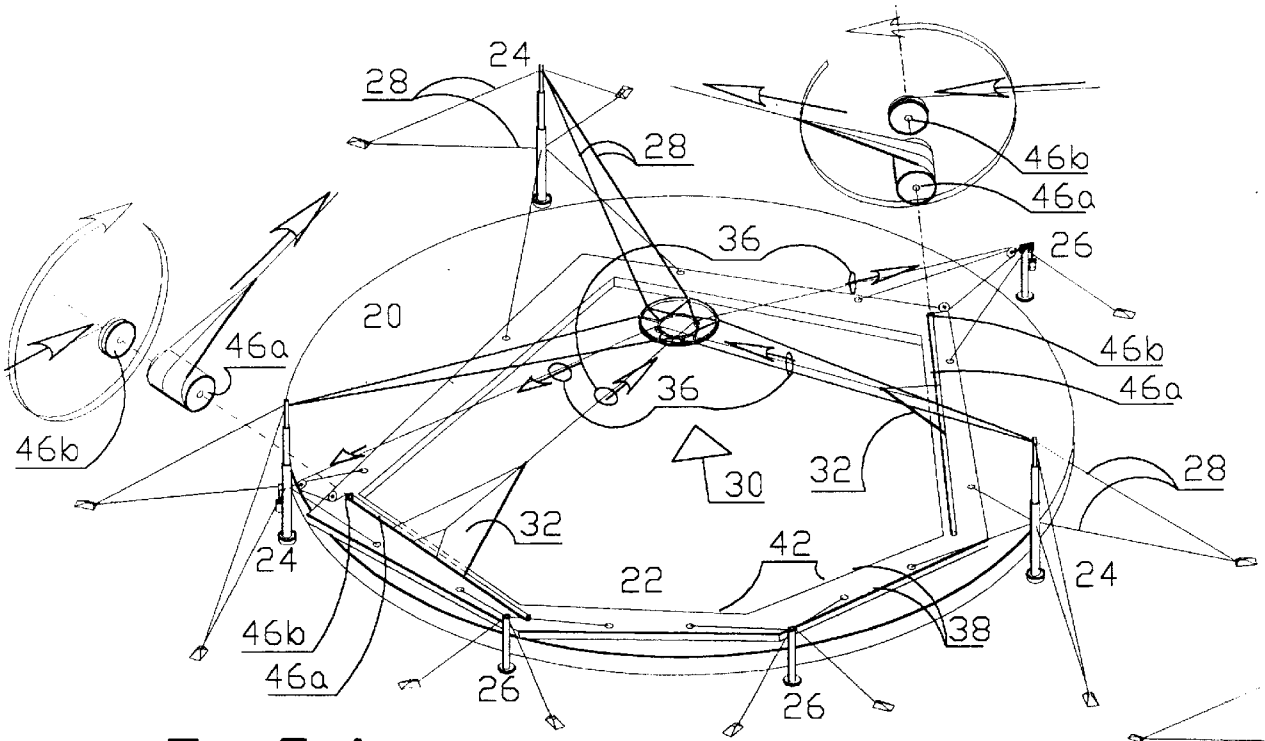
FIG 7-A
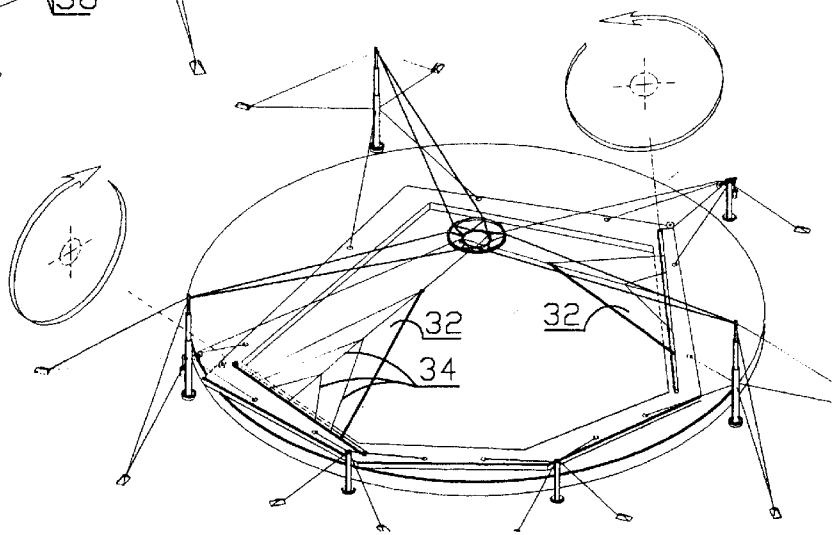
FIG 7-B

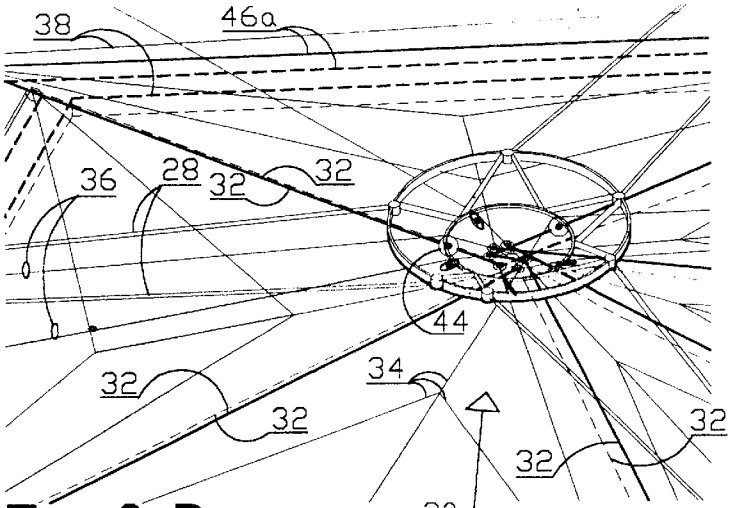
FIG 8-B
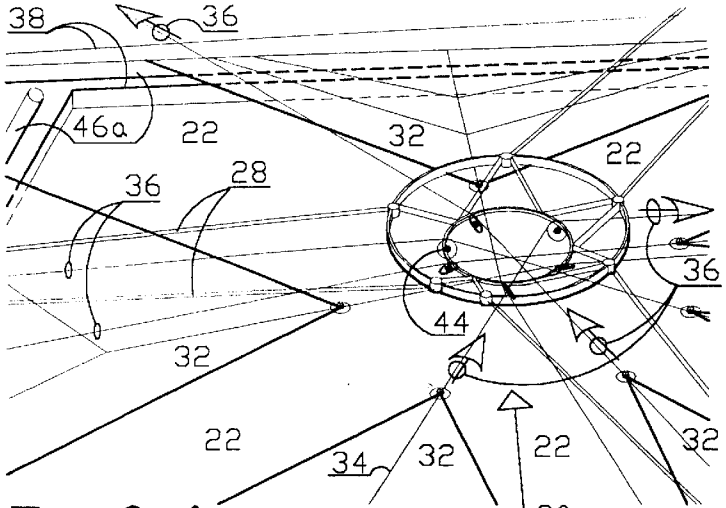
FIG 8-A
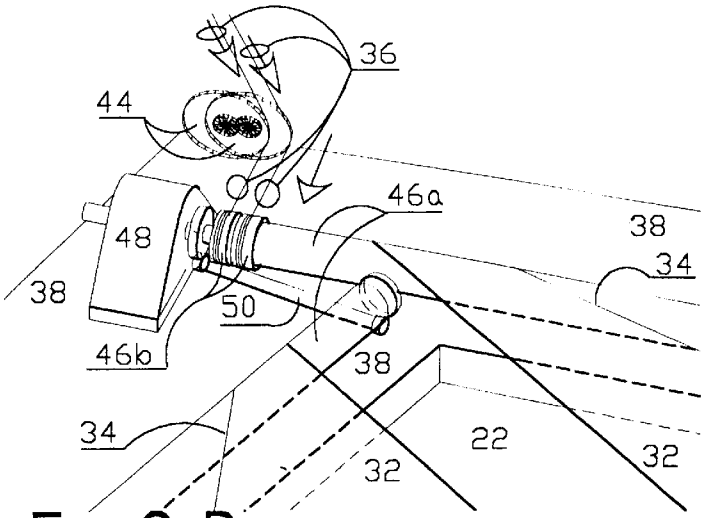
FIG 9-B
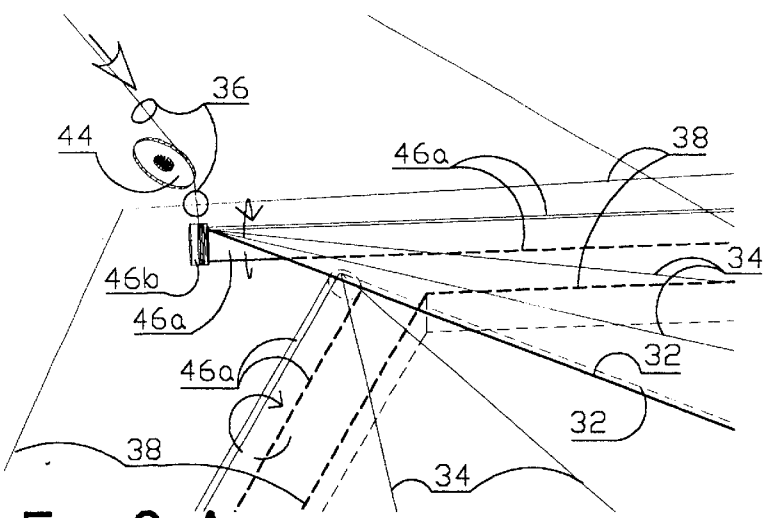
FIG 9-A

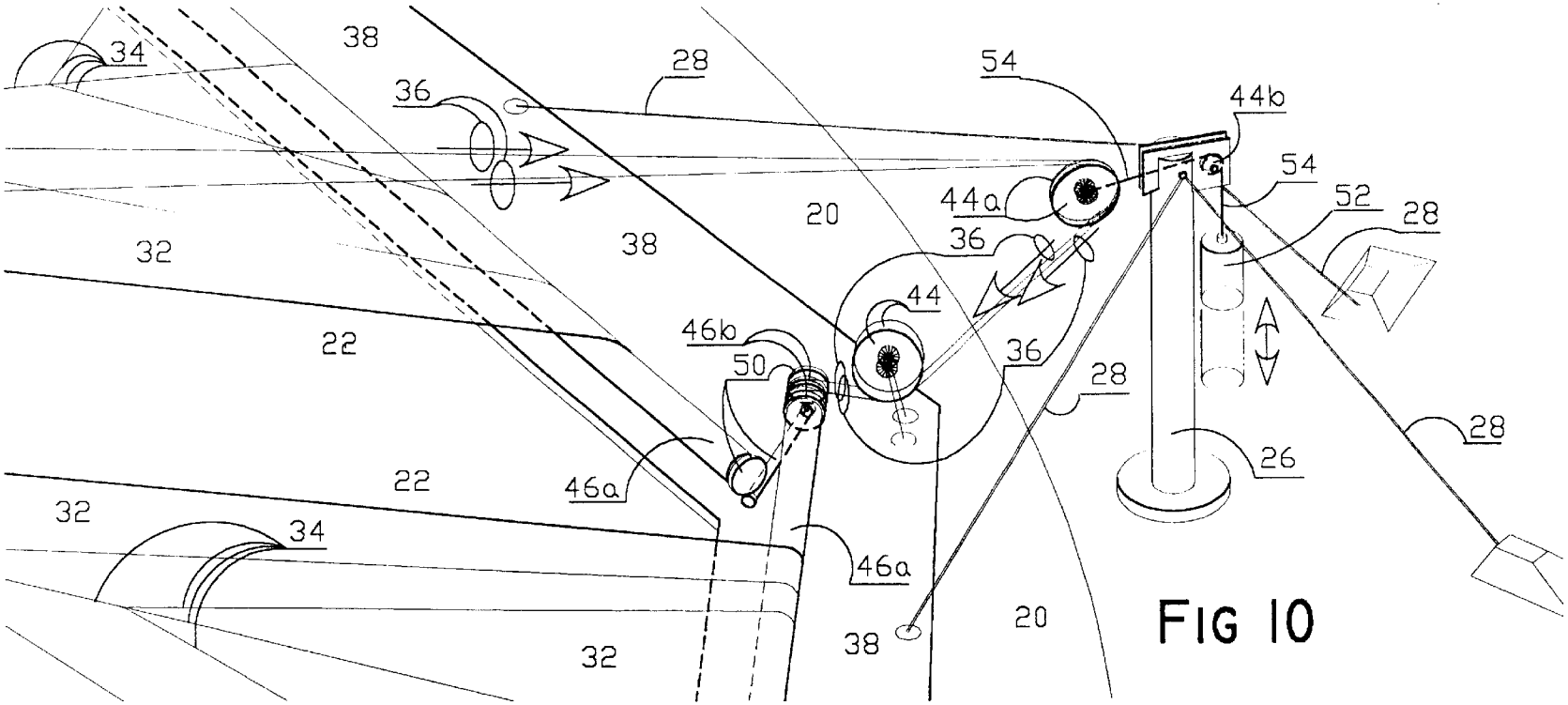
FIG 10
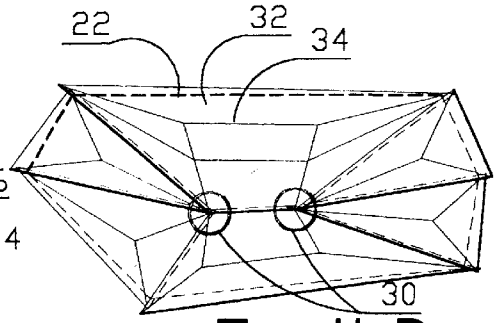
FIG 11-D
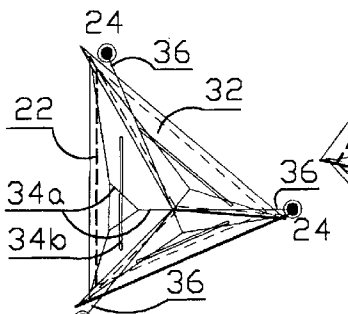
FIG 11-C
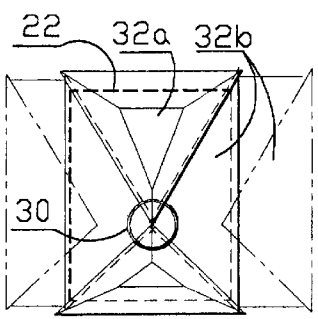
FIG 11-B
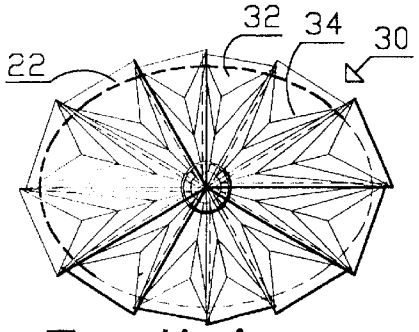
FIG 11-A

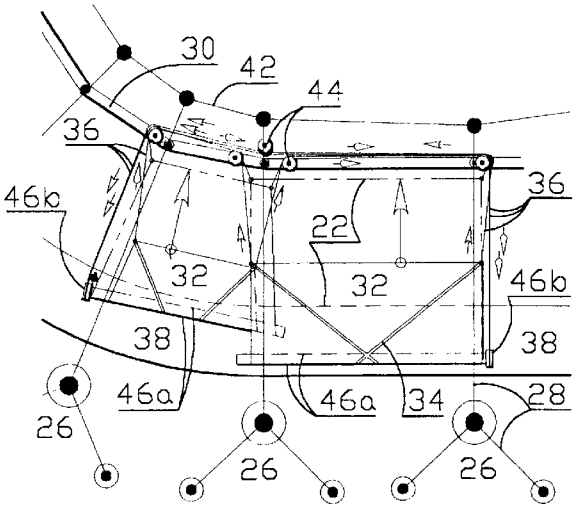
FIG 12-B
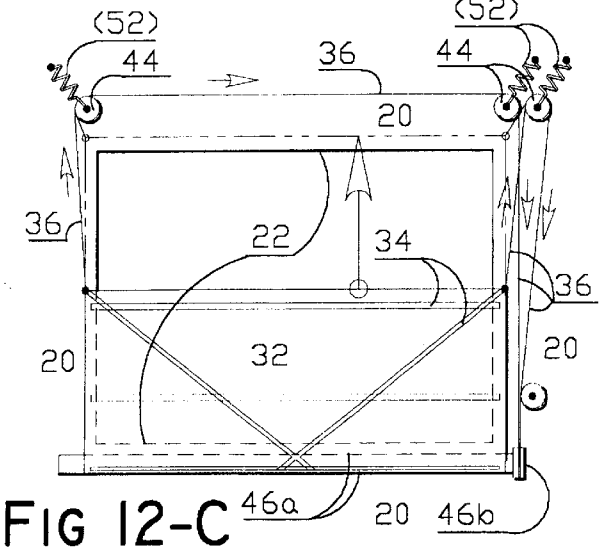
FIG 12-C
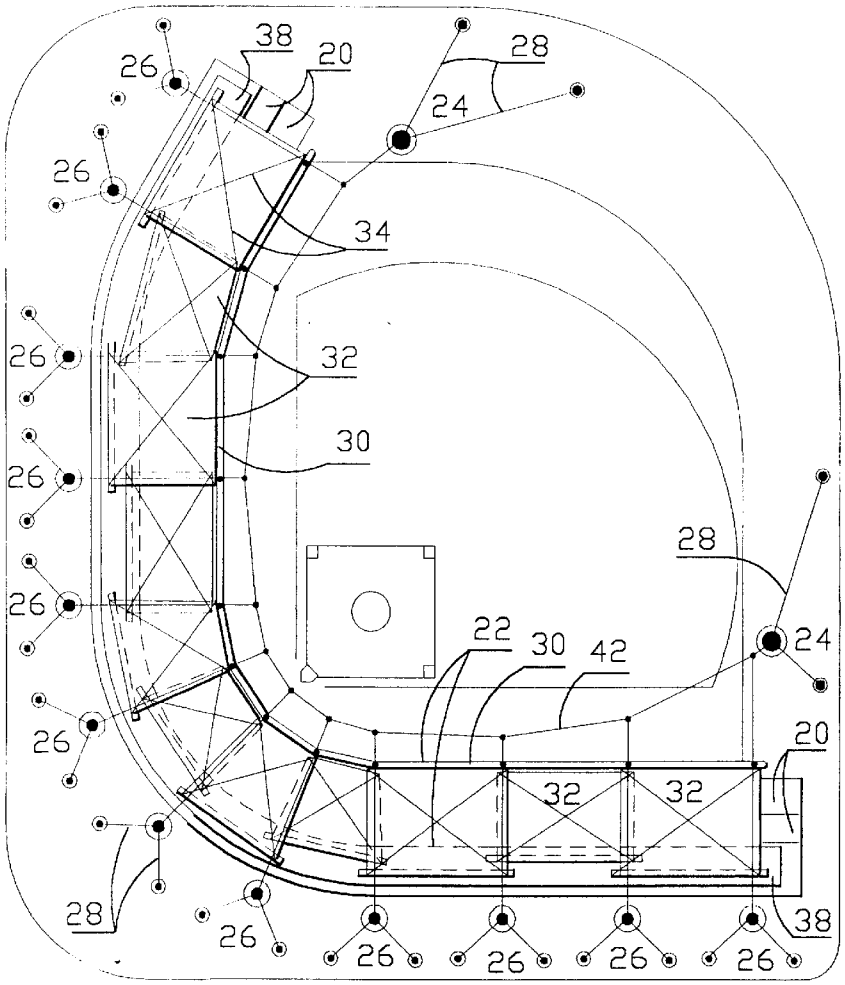
FIG 12-A

RETRACTABLE COVERING FOR SPACES

BACKGROUND—FIELD OF THE INVENTION

This invention relates to buildings and other functional spaces, specifically those which may alternately benefit from both open-air use and the provision of overhead protection. It is adaptable to any size and shape of space, from very small, e.g. residential courtyard; to very large, e.g. sports stadium.

BACKGROUND—DESCRIPTION OF PRIOR ART

Although relatively few in number, retractable coverings designed for buildings and spaces, particularly for very large spaces such as sports stadia, are generally of two varieties. They may be (a) large movable roof elements or (b) lighter assemblies of more-flexible materials used in panels or membranes, and braced in various ways.

The first variety is only indirectly related to the present invention and is also quite rare, as the roof components tend to be heavy and expensive to build, maintain and operate. Robbie's SkyDome is an example which consists of three massive, rigid segments which are slidably and rotatably operated to form a complete enclosure. When open, however, large portions of these elements still remain in view. It has been reported that this retractable covering takes 20 minutes to close, and also takes a great deal of power to retract and deploy; each such operation reportedly consuming more than $500 worth of electricity. Recent patents for this variety, such as Sugizaki's Operable Roof and Kida et al.'s Operable Dome-shaped Roof Structure tend to share these same disadvantages. Large movable roof elements are usually found applied only in new facilities, where their demanding requirements can be accommodated. Regarding the present invention, they illustrate the desire and need for a roof covering for large-scale buildings which can be retracted The second variety, lighter assemblies, is directly related to the present invention. Flexible materials have been greatly-improved in recent years, and there has been a wide range of fixed-roof applications of these materials. However, retractable coverings of this variety have been limited in application, usually for small-scale and intermediate-scale projects. The lack of large-scale application of these new materials is even more pronounced. To date, patents for this variety often rely upon rectangular panels and rectangular configuration of rigging. They therefore lack the necessary inherent geometry for practical application and efficient use of the strength of flexible materials available. This geometry constraint also places limitations on the location and nature of structural elements. Most large stadia tend to be circular or oval in shape, and many employ compound curves in their geometry. Hence, adaptation of these patents to most large spaces is difficult. For example, both versions of Erickson's Night and Day Stadium relied on rectangular panels deployed by numerous rolling elements, and supported by numerous heavy fixed cables in rectangular arrays. Arrel's Canopy Structure relied upon separated rectangular panels with suspension loops for supporting the edges from intermediate fixed lines. W. Colvin, Jr.'s Roof proposed large, fixed truss elements together with rectangular panels. Consequently, all of these provide little or no possibility of using panels in a circular array. Additionally, a frequent disadvantage of this second variety is the reliance upon excessive apparatus, such as closely-spaced edge pulleys running on edge cables, or heavy trucks running on overhead cables to effect closure of the space. This reliance adds additional expense and weight as the scale of application increases.

Both types of retractable coverings often fail to address a further, and major, desirable characteristic. That is to provide such a covering which may also be retroactively applied to an existing large-scale structure. Most existing buildings are not limited merely by overall shape. Structurally, they are usually limited in their ability to carry new static or dynamic loads. In addition, other serious limitations may include insufficient space available for accommodation of a major new covering. Unfortunately, most concepts for retractable coverings presented to date cannot be adapted for such retroactive use without adverse consequences.

With the development in recent years of more-efficient and more-durable lightweight materials, new applications of coverings of all sizes have been realized. However, most of the large-scale applications have been limited to immovable, fixed-panel installations. These have commonly used either inflated or suspended membranes. Some applications have been retractable, but these are usually limited in scale and application. Otto's retractable covering for an open-air theater consists of three primary, independent, canopies freely gathered to a central point for retraction. In addition, secondary canopies, suspended underneath, are required to carry off rain water. Mitchell's Flexible Roof Furling System for Amphitheaters or the Like required a very tall mast for supporting a massive, continuous membrane covering, the base of which must be drawn around the entire perimeter in order to encircle the space.

An additional variety of retractable coverings consists of lighter retractable shading devices. These usually require a primary covering for protection from forces of wind and rain. Most of these are not adaptable for large-scale exterior applications. Fuller's Shading Device for Exp. '67, Montreal, in addition to requiring a primary covering, makes no provision for a continuous overlap of adjacent panels important for exterior applications.

Although not retractable, Beckett's (proposed) helical tension fixed roof structure for a sports stadium has shown how a circular array of helical cables may be utilized to form a fixed roof structure over a large space. No proposal has been evident that this principle may be used for a retractable roof.

The challenge remains to provide a universal lightweight covering system which allows both open-air, partially-closed, and completely-enclosed use—as desired. Such a system must be easily and efficiently built, operated and maintained. It should allow positive rainwater runoff. It should also present minimal visual obstruction when either open or closed. Ideally, this system should also be capable of installation on any size and shape of space—e.g. from a small courtyard for a private residence to a large athletic stadium. Perhaps most important, such a system should be practical for retroactive installation on existing buildings, without requiring structural revisions to the existing facilities.

OBJECTS AND ADVANTAGES

My retractable covering solves the aforementioned difficulties, allows for easy and economic outfitting of a multitude of new and existing facilities, and provides all-weather use for any space. Accordingly, a number of objects and advantages of my invention are as follows:

A Economical, durable and lightweight.

B Efficiently and quickly operated and placed in any desired intermediate position.

C Adaptable to spaces of any shape.

D Total coverage and effective closure with a minimum of panel material.

E No visual obstruction when open or closed.

F Structural design of overall system is inherently stable.

G Structural design of individual panels is inherently stable.

H Structural design minimizes cost of supporting structure.

I Reinforcing of panels maximizes utilization and strength of panel material.

J Interactive operation enhances efficiency of movement.

K Counterweight provides additional strength and shock-absorbing stabilization

L One motor may propel an entire array.

M Economical and practical for installation on existing structures.

N System is adaptable to perimeter-only coverage.

O System is adaptable for portable application.

With the ever-increasing importance of energy conservation, some of these qualities constitute one way of saving energy. On one hand, closing off a space from the elements may make it more comfortable—obviating or lessening any need for heating or air conditioning which consumes energy. On the other hand, the extension of the life and use of a building makes replacement unnecessary. Studies have demonstrated that very-significant quantities of energy are consumed in the process of simply fabricating the concrete and steel essential for buildings. Because my invention can be easily adapted to existing structures, increasing their usability and life-span, the energy which would have been used for replacement can be used for alternative uses.

Presently, despite public concern about energy conservation, at least one famous, structurally adequate (earthquake-tested) and still-useful sports stadium has actually been proposed to be demolished and replaced because it is too "windy". The simple application of my invention would diminish or remove this major objection entirely and could rejuvenate the entire facility with its continuing serviceability and widely-admired history. Great quantities of energy could thus be conserved by not having to replace it.

Further objects and advantages of my invention will become apparent from a consideration of the drawings and the ensuing discussion.

DRAWING FIGURES

In the drawings, closely-related figures have the same number, but different alphabetical suffixes.

FIGS. 1-A to 1-C show three views of 32-panel embodiment for a new sports stadium. Panels are shown in the fully-deployed, or closed position. Views are isometric, front and plan views, respectively.

FIG. 2 shows an isometric view of a 2-panel embodiment for a residential courtyard. One panel is deployed for shade. The other is retracted for sun.

FIG. 3 shows a perspective view of a 32-panel embodiment for an existing sports stadium. The panels are shown in an intermediate position.

FIGS. 4-A to 4-D show isometric views of a 6-panel embodiment for an asymmetrical space. Successive figures depict four positions for the panels. Shown are the retracted (open), first intermediate, second intermediate, and deployed (closed) positions, respectively.

FIGS. 5-A to 5-D show plan views of the same embodiment shown in FIGS. 4-A to 4-D.

FIGS. 6-A to 6-D show front views of the same embodiment shown in FIGS. 4-A to 4-D.

FIG. 7-A is a detail of one interactive pair of panels and cables from FIGS. 4-A to 4-D. The panels are shown beginning deployment from the retracted (open) position.

FIG. 7-B shows the same view with the panels approaching full-deployment (closure).

FIG. 8-A shows the control ring, with the panels and cables prior to closure.

FIG. 8-B shows the same view with the panels fully closed (deployed)

FIG. 9-A shows a portion of the service platform, illustrating the reels for panels and cables.

FIG. 9-B shows another portion of the service platform, illustrating a motor and a transfer drive.

FIG. 10 is a view of a counterweight and its relationship to movable cables and panels.

FIGS. 11-A to 11-D show various dispositions and configurations for the retractable covering FIG. 12-A shows a modification of the invention which provides perimeter-only coverage Panels are shown in the fully-deployed, or closed position.

FIG. 12-B shows a detail of the rigging of FIG. 12-A. Panel are shown in an intermediate position.

FIG. 12-C is a plan view of a single panel application of the invention. Panels are shown in an intermediate position.

REFERENCE NUMERALS IN DRAWINGS

| | |
|---|---|
| 20 | building |
| 22 | open space |
| 24 | primary tower |
| 26 | secondary tower |
| 28 | stationary cable |
| 30 | control ring |
| 32 | retractable panel |
| 34 | panel reinforcing |
| 36 | retractable cable |
| 38 | service platform |
| 40 | roof |
| 42 | tension ring |
| 44 | pulley |
| 46a | panel reel |
| 46b | cable reel |
| 48 | motor |
| 50 | transfer drive |
| 52 | counterweight |
| 54 | counterweight cable |
| 56 | service car |

Description—FIGS. 1A to 10

The retractable covering of my invention is readily-adaptable to a wide variety of sizes, types and shapes of spaces. Therefore, a few representative examples of these embodiments are presented. The applications illustrated range from large-scale to small-scale. The subsequent detailed discussion of the elements of my invention will focus on the fourth embodiment, shown in FIGS. 4 to 10.

All figs show that each embodiment of my retractable covering may be similarly applied to a facility, or a building 20. The purpose of the covering is to provide overhead protection or other enclosure for an open space 22 which may be surrounded by structure. Depending on the application, there may be a number of primary towers 24 and/or secondary towers 26 located at the perimeter of the open space or the surrounding building. A number of stationary cables 28, may be suspended from the towers. Some of these cables may be used to support a service platform 38. Other cables may support a suspended annulus, or a control ring 30. This ring may be located at some predetermined level and location above the open space. Whether or not the control ring is utilized, the common component of all embodiments is a helical array of sloping retractable panels 32. These panels may have a panel reinforcing 34 for maximum strength and efficiency. Attached to each panel is a co-active line, or a retractable cable 36. The entire array of panels and cables may be fully-deployed, drawn near to a central predetermined point. All panels and cables pass at predetermined distances from each other in a helical-pattern the pattern of a helix about this point. Properly configured and shaped, the edges of these converging panels can overlap when fully deployed, thereby creating complete coverage of the space. Alternatively, this array of panels may be partially-, or fully-retracted to the perimeter of the open space. Around this perimeter, retracted panels and cables may be stored on a service platform 38. Above this service platform may be provided a roof 40 for protecting all gear. Depending on various factors, some or all of the aforementioned elements may be utilized. In some cases, only a few of the elements will be needed.

FIGS. 1-A to 1-C show an ideal embodiment of my retractable covering. Various elements of the present invention have been integrated with the design of the building. Such a facility presents a space to be covered which may measure more than 150 meters of width, or clear opening. Control ring 30 may be more than 60 or 70 meters above the space to be covered. When retractable panels 32 are fully-deployed, or in the closed position, their adjacent edges overlap by one or two meters. The panels are designed to allow these edges to maintain this continuous overlap, ensuring a reliable, protective covering over the space.

When the panels are fully retracted, or open, only the control ring and the helical array of retractable cables is visible to the spectators. The panels may consist of any flexible assembly or material. They may also have various visual characteristics, such as opaque, translucent, or transparent membranes; or an open-web network for simple shading. Primary towers 24, whose minimum height is based only on the desired height for the control ring, may be pylons or other suitable structure.

FIG. 2 shows a much smaller-scale embodiment, such as for a residential courtyard. Only the basic elements of the invention are necessary in this instance. Open space 22 may measure only a few meters, or less, in width and/or length. In this case, retractable panels 32 and retractable cables 36 have no need for a control ring or supporting towers. Instead, the surrounding building provides sufficient support and stability. Each retracted panel is stored on a panel reel 46*a*. A strategically-located pulley 44 guides the cable for proper alignment of each panel. Even for such small-scale applications, panel reinforcing 34 may be desirable, providing added strength and stability against forces of wind and rain.

FIG. 3 shows the most challenging embodiment of the invention. It shows the retractable covering retroactively applied to an existing stadium. As such, it must be self-supporting—i.e. structurally independent of the existing structure. It must also be capable of large-scale application. Furthermore, it must conform to an asymmetrical and irregularly-shaped plan configuration. The structure and the function of the existing facility shown have not been affected by the retrofit installation. In addition to taller primary towers 24, there are a number of secondary towers 26. These do not require the height of the primary towers because they are not required to carry the higher control ring 30. Like the primary towers however, they are spaced at predetermined points around the perimeter of building 20. All of the towers combine to carry all loads of the retractable covering system. The inner perimeter of service platform 38 contains a continuous tension structure, or a tension ring 42. This structural element keeps the bottom of the service platform suspended at a predetermined distance above the existing roof. This tension ring, in some form, is required for such applications in order that no structural loads will need to be carried by the existing building. However, for many applications of my retractable covering, this tension ring may not be required, as most loading is carried by the perimeter towers. Thus, the lesser loading of the inner perimeter of service platform 38 may easily be borne by many existing structures.

FIGS. 4-A to 4-D show aerial views of a comprehensive embodiment of my retractable covering, illustrating four positions for retractable panes 32. This embodiment, although of irregular shape, is the prime model for the detailed description which follows. All features of the invention are utilized so that the fullest use of the system can be appreciated. It is analogous to the prior embodiment shown in FIG. 3, being assymetrical, self-contained and independently supported. The size is indeterminate, but considered to be intermediate-scale. The average width of open space 22 to be covered measures about 75 to 100 meters in width.

The covering material in retractable panels 32 may be any suitably-flexible assembly or material capable of repeated retraction and deployment. Also, the covering material may be opaque, translucent, transparent, or an open network. Each panel contains, at its edges and within its field, a network of panel reinforcing 34. This reinforcing may consist of high-tensile-strength material attached to, underlying, or integrated with, the covering material itself. This reinforcing may be such means as: cables encased at joints in the panel material, tensile material bonded or otherwise combined with the covering material itself, or any material of sufficient strength and flexibility. This reinforcing network may be structurally self-sufficient, i.e. structurally independent of the panel covering material itself. Furthermore, this network may be so routed within the boundary, or field, of a panel, that the ends of the network gather at the corners of the panel. FIG. 4-D best-illustrates that, when the panels are in the fully deployed or closed position, the corners provide the strongest points for panel support and the gathering point for panel reinforcing 34.

Illustrated in FIG. 4-A are three positions for an accessory service car 56. The first position, shown on the left, indicates the service car dismounted and stored on service platform 38. The second position illustrated shows the service car moved into position for rigging to retractable cable 36. The third position shows the car in transit to control ring 30 while attached to retractable cable 36 for retractable panel 32. This service car may be used for transporting personnel and equipment to control ring 30 for service and repairs. It's use is most-important for larger-scale applications of the invention. Smaller applications may use variations of the concept as simple as a boatswain's chair to permit similar access to remote components. Simple embodiments may not require this provision.

FIGS. 5-A to 5-D best illustrate the variable configuration of individual retractable panels 32. The travel length of any panel is measured along a line perpendicular to the base of the panel and intersecting the retractable apex of the fully-deployed panel. Both the travel lengths and the widths of the bases of panels are variable for any and all panels in an array. This variability makes the retractable covering applicable to virtually any size or shape of space. Control ring 30 is the meeting point of all panels when they are in the closed position. The apexes of the panels are the attachment points for their respective attached moving cables. Also best-illustrated in this series of Figs is the circular pattern of the panels as they are being retracted or deployed.

FIGS. 6-A to 6-D most-clearly show that the height of primary towers 24 is primarily determined by the desired height of control ring 30. The height of secondary towers 26 may be less than this because they do not to carry this highly-positioned load. Another factor allowing decreased height is the fact that pulleys in the control ring allow retractable cables 36 to return directly to service platform 38 after reaching their desired elevation. All static and dynamic loading of the entire system, including service platform 38, is in suspension above the top of building 20 by means of stationary cables 28. FIG. 6-A best illustrates that, when panels 32 (not seen) are fully retracted (open), the primary apparatus visible above the open space may be control ring 30 and retractable cables 36. The towers, being located at the perimeter of building 20, are of secondary importance when viewed from the central open space 22.

FIGS. 7-A & 7-B show the rigging of a system of one pair of interactive panels 32 in an array. As retractable cables 36 traverse open space 22, it is not necessary that they travel in a straight line. Pulleys located in control ring 30 enable each of the cables to travel upwards toward the control ring, and then continue downwards toward service platform 38. These pulleys also allow a lateral change in direction, permitting a wide range of possibilities for rigging. Upon reaching the opposite side of the space, the retractable cable for each panel may be routed through additional pulleys until it reaches a drum, or cable reel 46*b*. This cable reel may be connected to an adjacent panel reel 46*a* for its corresponding panel. These interconnected reels are each wound in opposite rotational directions, thereby creating an interactive and synchronous system of movement. Arrows indicate direction of movement during deployment of the panels.

FIGS. 8-A & 8-B show that control ring 30 is the central gathering point for all forces of retractable cables 36 and their attached retractable panels 32, including forces from panel reinforcing 34. These forces are transferred to the control ring by a number of pulleys 44 which are mounted on the control ring. The control ring itself is a tension ring of predetermined size, supported by stationary cables 28, in turn supported by the primary towers. In this illustration, the control ring is depicted as a two-tiered assembly, with the lower tier representing a catwalk for servicing the pulleys, as for a large scale application of the invention. Alternatively, the catwalk itself may form a single tension ring, or be eliminated, and pulleys suspended from a one-tier tension ring.

The pulleys may be precisely located at predetermined points on the circumference of the ring. These points determine the helical crossing of the panels and their attached retractable cables. Consequently, there is created a predictable horizontal and vertical clearance between adjacent retractable panels and their respective moving cables.

FIG. 8-B shows that, once closure is complete, an overlap of all adjacent panels may be created. The control ring can provide further stability and alignment control for these overlaps. The placement of guides at specific locations on the control ring can provide stabilizing, downward force on the apex of each deployed panel. Such guides may also ensure the proper overlap of adjacent deployed panels. Alternatively, because the exact configuration of the helical crossing is variable, this overlap may be eliminated altogether and spaces allowed between the fully-deployed panels.

Control ring 30 may be of any predetermined aspect and size. Pulleys 44 may be replaced by other devices for controlling alignment, such as simple guides which would serve the same function. Furthermore, as in a residential or other small-scale application, the control ring may be entirely eliminated. It may also be as simple as a unitary and free-floating ring which fixes the gathering point of deployed panels.

FIGS. 9-A & 9-B show the overlapping juxtaposition of the ends of adjacent panel reels 46*a* mounted on service platform 38. This overlap ensures a continuous overlap of deployed retractable panels 32. The overlap of the reels may be formed either horizontally (as indicated here), or vertically. Alternatively, this overlap may be eliminated if desired and a predetermined space provided between deployed panels. Also shown in these figs is the convergence of panel edges and panel reinforcing 34 at the ends of the panel reels when the panels are fully-deployed. This convergence allows for a full concentration of panel loads at the point of strongest support for each panel reel.

FIG. 9-A depicts the overlap of two independently-operated panel reels 46*a*. Pulley 44 allows retractable cable 36 to be reeved upon cable reel 46*b* as required.

FIG. 9-B shows how a motor 48 may be connected to a series of interactive cable reels 46*b* and panel reels 46*a*. Alternatively, a means of linear propulsion may be applied to retractable cable 36 at some intermediate point in the line. Manual means of imparting such propelling forces is a further option, particularly for small-scale applications. Also illustrated here is a means of transferring propulsive energy from one non-aligned reel to another, or a transfer drive 60. This may be in the form of a geared transmission as depicted here, a drive train with universal joints, a series of pulleys and cables, or other suitable means.

FIG. 10 shows one manner in which a counterweight 52 may be linked to a number of pulleys 44*a* for a number of retractable cables 36 by means of a counterweight cable 54. These pulleys, or a single pulley, may be positioned at some intermediate point on the path of retractable cable 36. Counterweight cable 54 is supported at primary tower 24 by a separate pulley 44*b*, mounted on the tower. For a large-scale application, the counterweight may weigh in excess of 10 tons. It may even be the dead weight of the service platform itself. Alternatively, this counterweight force may be substituted by other means, such as tension from a spring or the force of the motor previously described. In a small-scale application, manual tightening of the retractable lines, or cables, may be sufficient to apply adequate tension for panel stability.

FIGS. 11-A to 11-D show diagrams of four varied shapes of open space 22 to which my retractable covering may be applied. Many configurations of retractable panels 32 are possible for the spaces shown. Most importantly, virtually any shape of space imaginable may be accommodated by this retractable covering. In all cases, they may be arranged to provide complete coverage. Note that the configuration of panel reinforcing 34 is, likewise, adaptable to many configurations.

FIG. 11-B shows that the overlap of adjacent panels can be varied, with some panels overlapping both adjacent panels (and vice versa). Also illustrated here is the utilization of two flexible panels 32*a* and two solid panels 32*b*. Whereas flexible panels may be retracted on reels, as previously described, solid panels may be retracted in their entirety. Both types of panels may benefit from the use of a control ring. The projection lines show the open position for the two solid panels.

FIG. 11-C illustrates that control ring 30 (shown in FIGS. 11-A and 11-B) may not be required if primary towers 24 are strategically located along the path of travel of retractable cables 36. Also illustrated here is a combination of panel reinforcing. Besides tension reinforcing 34*a*, each retractable panel in this embodiment also has compression (solid) reinforcing 34*b* positioned parallel to the base of the panels FIG. 11-D illustrates that panels are not limited to triangular shapes. The same operation and advantages may be provided with the use of rectangular and truncated triangular panels. Similarly, multiple control rings may be utilized as shown by the two rings in this diagram.

FIGS. 12-A to 12-C show that the principles for a circular retractable covering are equally adaptable to perimeter-only and single-panel application.

FIG. 12-A shows an embodiment of the invention which provides perimeter-only coverage of seating in open space 22 for a ball park. In addition, the limits of a confining site are represented. The primary difference with previous examples occurs in the central area where there are no panels or cables. In this case, the helical crossing of the paths of travel is hypothetical—occurring beyond the limits of the retractable panels. Nevertheless, the same overlap of adjacent panels, and the same adaptable and stable configurations of tension members are provided. Also, as for a circular array of panels, the rigging of various panels in an array may have synchronous and interactive motion.

The perimeter-only coverage is accomplished by using a combination of rectangular, or truncated triangular retractable panels 32 Curved portions of the arc are covered by wedge-shaped panels. Straight portions are covered by rectangular panels. The entire array is suspended from stationary cables 28 and anchored by primary towers 24 and secondary towers 26 located within the confines of the site. Tension ring 42 takes the form of an arc formed by a stationary cable suspended between the primary towers The arc of this tension ring is formed by resolving static tension forces with the stationary cables from the perimeter secondary towers. Control ring 30 takes the form of a suspended platform from which running gear is rigged.

FIG. 12-B is a detail from FIG. 12-A. Retractable cables 36 are rigged from the leading corners of retractable panels 32. Just as for a circular array, these cables are routed in a manner which provides synchronized, interactive operation. These retractable cables may be stored on cable reels 46*b* connected to panel reels 46*a* for respective, interactive panels. All other features and advantages of my invention, such as the panel overlap, are equally adapted here.

FIG. 12-C illustrates a single, rectangular retractable panel 32 providing a reinforced covering for open space 22. This embodiment utilizes features of the invention for greater stability and ease of operation. Counterweight (52) has been replaced by simple springs to provide additional tension force. Panel reinforcing 34 relieves the forces acting on the panel edges, allowing them to remain taut. Also shown here is the manner in which rigid, or compression, panel reinforcing may be provided. This reinforcing is rigid, but nevertheless capable of deployment, retraction and storage on reels. Such battens or other rigid material located in the field of the retractable panel may be positioned parallel to panel reel 46*a*. This allows for unimpeded winding of the retractable panel upon its panel reel as the rigid members are thus automatically positioned lengthwise along the reel.

Further illustrated in FIG. 12-C is the manner in which a single panel can utilize the feature of connected panel reel 46*a* and cable reel 46*b* for interactive operation.

From the description above, a number of the advantages of my retractable covering compared to prior art become evident:

1. Inherent configuration of tension members provides increased structural stability and strength
2. Fewer and Lighter members
3. Maximizes efficient use of material
4. Wide scope of application
5. Adaptable to any size or shape of space
6. Adaptable to perimeter-only application Operation—FIGS. 4A to 10

FIGS. 4-A to 4-D show that retractable panels 32 and retractable cables 36 are continuously deployable and retractable above open space 22. Because each panel and its respective cable are securely fastened at the apex of the panel, a unified movement is created for both of these elements. These combined elements, configured in arrays, may be drawn in unison, in individual pairs, or separately, to the helical meeting point near control ring 30.

FIG. 4-B best shows that, in an asymmetrical array, the longer panels may be the first to deploy enroute to control ring 30. Also depicted here is the manner of retractable cable rigging and movement across open space 22. The control ring allows cables from one side to change directions and continue downwards to the opposite side of the open space FIG. 4C shows that, despite the asymmetry and variable length of retractable panels 32, all panels may approach and arrive at full-deployment in unison. Thus, the longer panels, although having deployed first, may complete their longer path of travel at the same time as the shorter panels.

FIG. 4-D illustrates that, once each of the retractable panels 32 is fully-deployed, panel reinforcing 34 collects all tensile forces from the body, or field, of each panel. These networks, in turn, carry all of these forces directly to the corners of the panels. These corners are the strongest load-bearing points. As a result, each edge of the panels is required to carry only minor loading, thereby minimizing edge deflection. Thus, the panel edges remain taut and most of the static and dynamic forces acting on the panels, including wind and rain, are carried internally. As a further benefit, the covering material itself is also relieved from bearing any forces beyond its own capacity. Being so-relieved of excess strain, the panel material may consist of virtually any suitable material. Most importantly, deployed panels may carry additional forces which may far-exceed the forces needed for support and operation alone. This additional force amplifies the strength and stability of the entire assembly. One means of applying this additional tension force will be described in FIG. 10 below.

Although of secondary significance, FIG. 4-A also illustrates the operation of the accessory service car 56. Normally, this vehicle may be dismounted and stored on service platform 38. When needed, it may be mounted upon retractable cable 36 when panel 32 is retracted. By the simple deployment of the panel with the car thus attached, the car will automatically be transported to control ring 30. For less-intensive applications, the alternative and similar use of a boatswain's chair or other carrying means may be sufficient.

FIGS. 5-A to 5-D illustrate the plan view of the operation described in FIG. 4.

FIG. 5-A shows a portion of roof 40 which may be provided to protect all running gear.

FIG. 5-B illustrates the circular pattern of the panel movement as panels 32 approach full deployment. Also, with synchronous operation, panels with shorter travel distances from base to apex are the last to deploy. Thus only five of the panels appear to be beginning deployment.

FIGS. 5-C & 5-D show the panels completing their travel to control ring 30.

FIGS. 6-A to 6-D illustrate the side view of the operation described in FIG. 4. It may be seen that, during operation of panels 32, observers may not be able to detect the movement of retractable cables 36 as these members merely travel longitudinally. This illusion will add an atmosphere of magic to the experience of the movement of the panels appearing suddenly from the end of the cables.

FIGS. 7-A & 7-B illustrate the operation of an interconnected, and interactive, pair of retractable panels 32. The rotation of each cable reel 46*b* for retractable cable 36 is connected to the adjacent panel reel 46*a* for the corresponding retractable panel. This connection results in a unified action of all movable gear for the interactive pair. The diagrams with the directional arrows show a simple manner in which this action can be unified. As illustrated here, adjacent and co-axial reels may be wound in opposite directions. Therefore, when a cable reel is retracting cable, the connected panel reel is simultaneously deploying panel material. In similar fashion, when a cable reel is deploying cable, the panel reel is retracting panel material. Thus, this pair of panels, moves in synchronous motion—when one panel moves, the corresponding panel moves equally. The same result may be created, without opposite-winding, through the use of a reversing gear or other mechanism. Such linking of the operation of pairs of panels helps to equalize loading on the system and reduce the number of motors and other gear to implement a complete system of retractable panels.

Because the retractable panels 32 may be of different lengths, the shorter panel will be the first to become fully retracted on its panel reel 46*a*. In this case, retractable cable 36 attached to this shorter panel will continue to wind upon its panel reel. This winding continues until the longer interactive panel has become completely retracted upon its own panel reel. It may be seen that, during a deployment of the same panels, the operation is the reverse of the foregoing.

This interactive-pair operation is one option for application of my retractable covering. However, individual panel movement may be preferred for certain purposes, such as providing shade on only one side of a space, or providing a more basic operation. In a small-scale application, each reel might simply have its own spring-activated retraction mechanism similar to that for a window roller shade. In another application, each cable reel 46*b* might be directly attached to an independent motor for deployment of each individual panel. A further option might be a simple pull cord which could be manually operated to provide the same deployment. These are only a few examples of many possible variations.

FIGS. 8-A & 8-B show the helical pattern of operation for retractable cables 36 and panels 32 at control ring 30. Pulleys 44, located at predetermined locations on the control ring, precisely establish the desired helical pattern. This precision means that, at all times, the panels and cables pass in juxtaposition to each other by a set horizontal and vertical distance. This helical configuration may allow any number of multiple, adjacent panels to overlap when they are completely closed as shown in FIG. 8-B. This pattern also allows them to operate either independently or simultaneously. The apexes of the panels may be drawn upwards toward the control ring, even passing the center point of the array. The panels may continue their travel until the overlapped edge of one panel comes into contact with the overlapping body of the adjacent panel. In this manner, the overlap may be continuous along the entire length of adjacent panels. This continuous overlap offers positive protection from weather. Rain, falling on the main body of the panel, is carried naturally down the fall line of the panel. This rainwater runoff may then be collected and drained away below panel reels 46*a* located at the base of panels 32.

In addition to fixing the helical configuration, pulleys 44 mounted on control ring 30 also carry a significant portion of the loading of a system of panels. As retractable cables 36 cross these pulleys, they change direction downwards and the vertical load of the cables is transferred to the control ring. This vertical load includes loading from panel reinforcing 34 with its collected forces from retractable panels 32. This loading is then carried by stationary cables 28 anchored by the primary towers described earlier.

It may be seen that control ring 30 is an optional feature of my invention and may be eliminated entirely. The same helical configuration of the prior discussion may be duplicated without the benefit of a control ring. One way would be to simply provide taller towers at the perimeter of open space 22. These towers would be strategically placed to intersect with the extrapolated paths of travel for retractable panels 32. Another way to eliminate control ring 30 would be to lower the peak, or meeting point for retractable panels 32. Since one of the reasons for using the control ring is to provide such additional height for the peak of the retractable covering, if this height is not required, then a control ring might not be needed. In fact, if little or no additional height is needed, then the towers at the perimeter of open space 22 might also be eliminated. For example, if the level of the peak is close to the level of service platform 38 and panel reels 46*a*, then retractable cables 36 may be rigged at the service platform, thereby obviating the towers.

FIG. 9-A & FIG. 9-B illustrate the relative movements of adjacent panel reels 46*a*, and interactive panel movement. Both illustrations show a detailed view of the opposite winding and interconnection of panel reels 46*a* and cable reels 46*b*. When cable 36 is deployed, panel 32 is simultaneously retracted. Conversely, when the cable is retracted, the panel is simultaneously deployed. Also shown is the manner in which pulleys 44 can be positioned in various ways to guide each moving cable 36 on any predetermined path.

FIG. 9-A shows that two adjacent panel reels 46*a* may be independent in operation, yet still provide an overlap for the deployed panels.

FIG. 9-B shows that a motor 48 may be used to propel a cable reel 46*b* and other running gear attached or otherwise linked to it. Most importantly, illustrated here is one manner of linking the motion of adjacent panels in a series by means of a transfer drive 50. Thus connected, it is possible for only one motor or other propulsive force to operate two or more reels in unison. If panels are further rigged in interactive pairs, it is possible for only one such propulsive force to fully-power an entire array of panels by connecting only half of the reels in the array with some form of this transfer drive.

In a residential or other small-scale application of my retractable covering, the motor may be eliminated. A simple hand crank or an endless loop may be substituted to apply manual motive force.

FIG. 10 shows one means by which additional stabilizing, and shock-absorbing, tension may be applied to deployed retractable panels 32 via retractable cables 36. Because each retractable cable is attached to a corresponding panel, any tension applied to one of these cables is transmitted directly to its panel. In this illustration, this tension is applied at a turning point of retractable cable 36 by cable pulley 44*a*. This pulley communicates with a counterweight 52 by means of a counterweight cable 54. Thus, the stabilizing force of the tension from the counterweight is transferred directly to the retractable cable. The resultant forces are transferred to tower 24 through a counterweight pulley 44*b* mounted on the tower. This counterweight pulley allows the counterweight itself to move up and down, and the pulley guiding the retractable cable to move back and forth in unison with it. Any sudden shock or movement in the retractable cable may thus be absorbed by the corresponding movement of the counterweight.

An important feature of this counterweight force is the very high loading that may be applied. This may be particularly beneficial for large-scale applications where great forces may accumulate. In such cases, counterweights weighing many tons may be used for each panel. As one alternative to the use of counterweights, equivalent tension might even be derived simply from the dead weight of service platform 38. Regardless of the source of the tension, the exact amount may be predetermined. Therefore, panel reinforcing and retractable cables may be specifically designed accordingly. A maximum design force may thus be imparted to the deployed panels. This additional force further stabilizes the entire assembly against forces of wind and rain.

Through hydraulic or other means, this tensional force may be repeatedly decreased and reapplied. During operation of the panels, this tension may be nearly eliminated. By minimizing this force during operation of the panels, much friction may be relieved from moving parts. This results in a more economical and more rapid operation of the systems during retraction or deployment. Consequently, a complete deployment or retraction cycle may be measured in seconds, rather than a number of minutes. Additionally, the cost of these operations is correspondingly minimized.

Alternative means of tensioning, such as a spring or the force of a motor used for motive power, may also be used to apply sufficient additional force once deployment is completed. In a small-scale application, manual tightening of the retractable lines, or cables, may be sufficient to provide the same proportional forces.

SUMMARY, RAMIFICATIONS, AND SCOPE

Accordingly, the reader will see that any space utilizing my retractable covering provides the advantages of both open-air use, and enclosed protection from the elements, as desired. In favorable weather the retractable panels may be fully retracted for the greatest enjoyment of the open air. Equally important, preferred natural vegetation may be used for landscaping or for playing fields for sports. In only a few minutes, or even seconds of time, the covering may be quickly and economically closed, providing reliable weather protection. Additionally, aesthetic and acoustical advantages may be provided for concerts or other gatherings. In the case of a sports stadium equipped with my retractable covering, one can even imagine a brief and exciting operation of the panels upon an important score by the home team.

From the above description, it is evident that there may be a multitude of embodiments for many sizes, shapes, and types, of spaces. Some may measure more than 100 meters of clear opening; others, only 1 or 2 meters in width. Some may be circular or oval; others, simple squares or rectangles. Some may provide formal enclosure; others, very informal.

Since most of the requisite structure may be accomplished by using simple tension members, embodiments may easily be made for temporary or even portable use. They may consist of all the elements described, or only a few. Even individual elements of the invention may take various forms and still provide similar effects in any embodiment. For example: the walls of a building may provide the major support of the primary and secondary towers which have been described; light ropes may replace cables; hinged, insulated rolling panels—or even solid roof segments—may replace flexible panel membranes or flexible networks; rotating frames may replace reels; simple guides may replace pulleys; and so on. Even a single retractable panel may utilize the interactive winding feature, or the counterweighted tensioning feature for greater stability and ease of operation.

In addition to making this straight-forward adaptability possible, the inherent configuration of my retractable covering also allows variable horizontal and vertical locations for the meeting point of the deployed panels. This variability makes panel configurations virtually limitless. Furthermore, the natural accommodation of well-braced panel reinforcing maximizes the efficient use of virtually any covering material, regardless of its strength.

The general structural design provides important potential for suspending secondary functions, such as lighting catwalks, announcement and score boards, television projection screens, even viewing positions, from the static structure. In the process of retrofitting an existing facility with my retractable covering, it is also a relatively simple matter to simultaneously build new public facilities, concessions, or other ancillary space while constructing the new independent foundations and structure.

Operation of the retractable covering is quick and efficient, as the panels themselves may be extremely light. Yet, once deployed, these panels can be tightened with great force to provide a stable and effective covering. Panels may be operated individually, in interactive pairs, or in coordinated sets of interactive pairs. In smaller scale applications, operating power may be provided by manual means, or assisted by spring-activated mechanisms. In most applications, panels will be motor-driven.

Although the description above contains many specific provisions, these should not be construed as limiting the scope of the invention. These specific provisions merely provide an illustration of some of the presently preferred embodiments of this invention. Thus the scope of the invention should be further defined by the appended claims and their legal equivalents.

I claim:

1. A retractable covering for a space, said covering comprising a plurality of retractable panels having three or four sides, said panels having shapes corresponding to sectional divisions of said space, each of said panels having one base side, said base sides mounted at the perimeter of said space, said panels having leading corners movable toward the inner portion of said space, said leading corners having fixedly attached thereto cables or other means of supporting in tension, said cables movable longitudinally along paths of travel passing in helical crossings near predetermined points above said space, said cables supported in tension beyond said helical crossings, said covering further including means for driveably retracting and deploying said panels and said cables whereby a full deployment of said panels may effect an overlapping of the edges of said space and an overlapping of the edges of adjacent said panels resulting in a covering of said space, said covering further including means for storing said panels and said cables when retracted.

2. The retractable covering of claim 1, said panels comprising flexible covering material, said panels having edges, fields, and corners, said edges having reinforcing means for accommodating tension forces along the edges of said panels, said fields having reinforcing means for accommodating tension and compression forces within said fields, whereby additional forces exceeding the capacity of said material may be accommodated, and whereby said forces may be concentrated at said corners.

3. The retractable covering of claim 1, further including an independently-supported platform located beyond said helical crossings and above predetermined points above said space, said platform having attached, at predetermined points, pulleys or other means for guiding said paths of travel of said cables, whereby the location and configuration of said helical crossings is fixed, and whereby forces from said cables may be transferred to said platform.

4. The retractable covering of claim 1, said cables further including extensions beyond said helical crossing, said extensions having means of returning to said base sides of said panels, said extensions fixedly attached to said base sides whereby forces between said extensions and said panels are joined, and whereby the motion of retraction and deployment of said panels and said cables, respectively, is unified and synchronous.

5. The retractable covering of claim 1, further including panel reels and cable reels for storage of said panels and said cables, respectively, said reels mounted at said perimeter of said space, said panel reels and said cable reels counterwound, respectively, and interconnected for synchronous rotation whereby an interactive movement is provided for said panel reels and said cable reels resulting in the retraction and deployment of said panels and said reels, respectively, being simultaneous, and whereby tension forces acting on said panels and said cables are unified.

6. The retractable covering of claim 5, wherein said panel reels and said cable reels are interconnected by geared or other means for providing synchronous rotation whereby said interactive movement is provided.

7. The retractable covering of claim 1, further including means of applying additional and variable tension acting perpendicular to said cables and said extensions at a predetermined point along said cables and said extensions, whereby an increase in tension provides an additional stabilizing force for said panels, and whereby a variable tension allows a shock-absorbing movement for said panels, and whereby a decrease in tension allows a more-rapid and more-efficient operation during deployment or retraction of said panels.

8. The retractable covering of claim 1, wherein said means of applying additional and variable tension is a counterweight.

9. A retractable covering for a space, said covering comprising a plurality of retractable panels having three or four sides, said panels having shapes corresponding to opposing sectional divisions of said space, each of said panels having one base side, said base sides mounted at the perimeter of said space, said panels having leading corners movable toward the inner portion of said space, said leading corners having fixedly attached thereto cables or other means of supporting in tension, said cables movable longitudinally along paths of travel passing in helical crossings near a predetermined point-above said space, said cables supported in tension beyond said helical crossings, said covering further including means for driveably retracting and deploying said panels and said cables whereby a full deployment of said panels may effect an overlapping of the edges of said space and an overlapping of the edges of adjacent deployed panels, resulting in a covering of said space, said covering further including means for storing said panels and said cables when retracted.

10. The retractable covering of claim 9, said panels comprising flexible covering material, said panels having edges, fields, and corners, said edges having reinforcing means for accommodating tension forces along the edges of said panels, said fields having reinforcing means for accommodating tension and compression forces within said fields whereby additional forces exceeding the capacity of said material may be accommodated, and whereby said forces may be concentrated at each corner of said panels.

11. The retractable covering of claim 9, further including an independently-supported annulus located beyond said helical crossings and above predetermined points in said space, said annulus having attached, at predetermined points, pulleys or other means for guiding said helical paths of travel of said cables whereby the location and configuration of said helical crossings is fixed, and whereby forces from said cables may be transferred to said annulus.

12. The retractable covering of claim 1, said cables further including extensions beyond said helical crossing, said extensions returning to the bases of said panels, said extensions fixedly attached to said bases, thereby joining forces between said extensions and said panels whereby the motion of retraction and deployment of said panels and said cables, respectively, is unified and synchronous.

13. The retractable covering of claim 9 further including panel reels and cable reels for storage of said panels and said cables, respectively, said reels mounted at said perimeter of said space, said panel reels and said cable reels counterwound, respectively, and interconnected for synchronous rotation whereby an interactive movement is provided for said panel reels and said cable reels resulting in said retraction and said deployment of said panels and said reels, respectively, being simultaneous, and whereby tension forces acting on said panels and said cables are unified.

14. The retractable covering of claim 9, further including means of applying additional and variable tension acting perpendicular to said cables and said extensions at predetermined points along said cables and said extensions, whereby an increase in tension provides an additional stabilizing force for said panels, and whereby a variable tension allows a shock-absorbing movement for said panels, and whereby a decrease in tension allows a more-rapid and more-efficient operation during deployment or retraction of said panels.

15. A retractable covering for a space, said covering comprising a plurality of retractable panels having three or four sides, said panels having shapes corresponding to perimeter segments of said space, each of said panels having one base side, said base sides mounted at the perimeter of said space, said panels having leading corners movable toward the inner portion of said space, said leading corners having fixedly attached thereto cables or other means of supporting in tension, said cables movable longitudinally along paths of travel passing in helical crossings located near a curvilinear series of predetermined points above said space, said cables supported in tension beyond said helical crossings, said covering and said cables further including means for driveably retracting and deploying said panels and said cables whereby a full deployment of said panels may effect an overlapping of the edges of said space and an overlapping of the edges of adjacent deployed panels, resulting in a covering of said space, said covering further including means for storing said panels and said cables when retracted.

16. The retractable covering of claim 15, said panels comprising flexible covering material, said panels having edges, fields, and corners, said edges having reinforcing means for accommodating tension forces along the edges of said panels, said fields having reinforcing means for accommodating tension and compression forces within said fields, whereby additional forces exceeding the capacity of said material may be accommodated, and whereby said forces may be concentrated at said corners.

17. The retractable covering of claim 15, further including an independently-supported platform located beyond said helical crossings and above predetermined points above said space, said platform having attached, at predetermined points, pulleys or other means for guiding said paths of travel of said cables, whereby the location and configuration of said helical crossings is fixed, and whereby forces from said cables may be transferred to said platform.

18. The retractable covering of claim 15, said cables further including extensions beyond said helical crossing, said extensions having means of returning to said base sides of said panels, said extensions fixedly attached to said base sides whereby forces between said extensions and said panels are joined, and whereby the motion of retraction and deployment of said panels and said cables, respectively, is unified and synchronous.

19. The retractable covering of claim 15, further including panel reels and cable reels for storage of said panels and said cables, respectively, said reels mounted at said perimeter of said space, said panel reels and said cable reels counter-wound, respectively, and interconnected for synchronous rotation whereby an interactive movement is provided for said panel reels and said cable reels resulting in the retraction and deployment of said panels and said reels, respectively, being simultaneous, and whereby tension forces acting on said panels and said cables are unified.

20. The retractable covering of claim 15, further including means of applying additional and variable tension acting perpendicular to said cables and said extensions at predetermined points along said cables and said extensions, whereby an increase in tension provides an additional stabilizing force for said panels, and whereby a variable tension allows a shock-absorbing movement for said panels, and whereby a decrease in tension allows a more-rapid and more-efficient operation during deployment or retraction of said panels.

* * * * *